US010542796B2

(12) United States Patent
Qin

(10) Patent No.: US 10,542,796 B2
(45) Date of Patent: Jan. 28, 2020

(54) LUMINOUS NECKLACE STRUCTURE

(71) Applicant: ACE GIFT & CRAFT(NINGBO) CO., LTD., Ningbo (CN)

(72) Inventor: Yanbei Qin, Ningbo (CN)

(73) Assignee: ACE GIFT & CRAFT NINGBO CO., LTD., Ningbo (CN)

( * ) Notice: Subject to any disclaimer, the term of this patent is extended or adjusted under 35 U.S.C. 154(b) by 0 days.

(21) Appl. No.: 16/181,487

(22) Filed: Nov. 6, 2018

(65) Prior Publication Data

US 2019/0069649 A1 Mar. 7, 2019

Related U.S. Application Data

(63) Continuation-in-part of application No. 15/438,824, filed on Feb. 22, 2017, now abandoned.

(30) Foreign Application Priority Data

Jul. 11, 2016 (CN) ..... 2016 2 0736383 U
Aug. 31, 2016 (CN) ..... 2016 1 0796312
Dec. 23, 2016 (CN) ..... 2016 1 1206968

(51) Int. Cl.
*A44C 15/00* (2006.01)
*A44C 11/00* (2006.01)
(Continued)

(52) U.S. Cl.
CPC ..... *A44C 15/0015* (2013.01); *A44C 11/00* (2013.01); *A44C 15/005* (2013.01);
(Continued)

(58) Field of Classification Search
CPC ..... A44C 15/005; A44C 15/0015; F21W 2121/06; F21V 23/001; F21V 23/023; F21V 23/04; F21V 23/0407; F21V 23/0414
See application file for complete search history.

(56) References Cited

U.S. PATENT DOCUMENTS 4,170,036 A * 10/1979 Sussel ..... A44C 15/0015 362/104
6,296,364 B1 * 10/2001 Day ..... A44C 15/0015 362/103
(Continued)

FOREIGN PATENT DOCUMENTS

CN 2171235 Y 7/1994
CN 203258473 U 10/2013
(Continued)

*Primary Examiner* — Alexander K Garlen
(74) *Attorney, Agent, or Firm* — NK Patent Law

(57) ABSTRACT

Disclosed is a luminous necklace structure. The present invention adopts the following technical solution: A luminous necklace structure, comprising a battery case; a chain rope with both ends connected with the battery case; at least one pendant connected with the chain rope; so that the battery case can supply power to the chain rope and make the pendant luminous. The chain rope comprises two conductive wires which are fixedly connected in parallel. The battery case comprises a casing and a power supply assembly provided in the casing, with two ends of the two conductive wires connected to the casing and the conductive wires electrically connected to the power supply assembly.

14 Claims, 10 Drawing Sheets

(51) Int. Cl.

| | |
|---|---|
| ***F21V 23/00*** | (2015.01) |
| ***F21V 3/08*** | (2018.01) |
| ***F21V 23/02*** | (2006.01) |
| ***F21W 121/06*** | (2006.01) |

(52) U.S. Cl.
CPC ..... *F21V 3/08* (2018.02); *F21V 23/001* (2013.01); *F21V 23/023* (2013.01); *F21W 2121/06* (2013.01)

(56) References Cited

U.S. PATENT DOCUMENTS

| | | | | |
|---|---|---|---|---|
| 7,036,962 | B2 * | 5/2006 | Chan | A44C 15/0015 362/103 |
| 2002/0089859 | A1 * | 7/2002 | Jackson | A44C 15/0015 362/571 |
| 2006/0044788 | A1 * | 3/2006 | Damrau | A44C 15/0015 362/104 |
| 2014/0230487 | A1 * | 8/2014 | Vasquez | A44C 15/0015 63/1.11 |
| 2017/0003003 | A1 | 1/2017 | Roos | |
| 2017/0023223 | A1 * | 1/2017 | Tsai | F21V 23/06 |

FOREIGN PATENT DOCUMENTS

| | | | |
|---|---|---|---|
| CN | 103431585 | A | 12/2013 |
| CN | 105054510 | A | 11/2015 |

* cited by examiner

LUMINOUS NECKLACE STRUCTURE

CROSS REFERENCE TO RELATED APPLICATION

This application is a Continuation-in-Part of U.S. patent application Ser. No. 15/438,824 entitled A LUMINOUS NECKLACE STRUCTURE filed Feb. 22, 2017, which application claims priority to Chinese Patent Application No. 201610796312.7 filed on Aug. 31, 2016, Chinese Patent Application No. 201611206968.5 filed on Dec. 23, 2016 and Chinese Patent Application No. 201620736383.3 filed on Jul. 11, 2016, the entire contents of which are incorporated by reference herein.

BACKGROUND OF THE INVENTION

1. Technical Field

The present invention belongs to the technical field of luminous ornaments, and more especially, to a luminous necklace structure.

2. Description of Related Art

The luminous ornaments are under the category of ornaments with a special structure in the field of ornaments. The combination of the light and ornaments through the provision of batteries and luminophors into the ornaments makes the ornaments more widely used and more popular among consumers. The luminous necklace is the more popular one out of a plurality of luminous ornaments, and they are particularly suitable for the festivals, such as Christmas and Halloweens, in some European and American countries. With a larger number of using methods, this kind of luminous necklace can either be worn on the neck, or hung in the Christmas tree and other objects, so as to enhance and boost a festive atmosphere.

The existing luminous necklace comprises a battery case, a wire (chain rope) electrically connected with the battery case and a luminophor fixed on the wire, wherein the luminophor is provided with light shades of various structures, shapes and colors. The luminous necklace of this structure has the following technical problems: 1. the luminophor and the light shade are connected in the only one traditional way which is too less selectable so that it cannot realize the provision and non-provision of lights in the light shades; 2. the luminophor is a consumable and cannot be fully protected by the light shade, and the connecting strength between the luminophor and wires is very limited, so the entire luminous necklace will not continue to be used due to the unchangeability of the luminophor connected in the traditional way, resulting in a shorter service life of the luminous necklace and causing a waste to a certain extent.

In summary, in order to solve the technical problems of the luminous necklace mentioned above, it is necessary to design a luminous necklace structure with diversified connecting methods which is convenient to use and has a longer service life.

BRIEF SUMMARY OF THE INVENTION

In view of the above-mentioned problems in the prior art, the objective of the present invention discloses a luminous necklace structure with diversified connecting methods which is convenient to use and has a longer service life.

To achieve the objective, the present invention adopts the following technical solution: a luminous necklace structure, comprising a battery case;

a chain rope with both ends connected with the battery case;

at least one pendant connected with the chain rope;

The battery case can supply power to the chain rope and make the pendant luminous.

Preferably, the pendant is a light shade which is electrically connected with a luminophor capable of being mounted on the chain rope, and the light shade is fixed to the chain rope and the luminophor via an injection molding process.

Preferably, the chain rope comprises two conductive wires which are fixedly connected in parallel.

Preferably, the battery case comprises a casing and a power supply assembly provided in the casing, with two ends of the two conductive wires connected to the casing and the conductive wires electrically connected to the power supply assembly.

Preferably, the outer casing comprises an upper casing, a lower casing and a connecting end cover, wherein the upper casing is detachably connected to the lower casing, and an inner cavity is formed between the upper casing and the lower casing for accommodating the power supply assembly, with the connecting end cover sleeved at the ends of the upper case and the lower case.

Preferably, the ends of the upper casing and the lower casing are respectively provided with a first latching strip and a second latching strip, with the first latching strip in contact with the second latching strip; the connecting end cover is provided with a latching slot, with the first latching strip and the second latching strip provided in the latching slot.

Preferably, the surface of the upper casing is provided with a strip-shaped groove extending through the upper casing, and two ends of the strip-shaped groove are spaced apart and adjacent to each other and enclose an elastic piece, with the elastic piece and the upper casing connected.

Preferably, the power supply component comprises a circuit board and a battery, with the circuit board provided with a contact piece electrically connected to the battery.

Preferably, the bottom of the elastic piece has a downwardly extending rod which can abut against the contact piece.

Preferably, the inner surface of the lower casing is provided protrusively with at least one position-limited rod, and one end of the circuit board is correspondingly provided with at least one position-limited hole, with the position-limited rod extending into the position-limited hole and connecting the circuit board to the lower casing.

Preferably, the lower casing is formed with a mounting groove for mounting a battery, and the circuit board is provided above the mounting groove and connected to the battery.

Preferably, the connecting end cover is provided with a through-hole communicated with the inner cavity.

Preferably, there are two batteries which are superimposedly arranged, wherein one of the batteries is in contact with the circuit board while the other is connected to the bottom of the groove of the mounting groove.

Preferably, the inner cavity is provided with a conductive wire, with one end of the conductive wire clamped to the bottom of the battery while the other end separated from the battery and electrically connected to the circuit board.

Preferably, one end of the conductive wire is bent to form a ferrule, and a lower surface of the mounting groove is protrusively provided with a fixing rod, with the ferrule sleeved on the fixing rod and in contact with the battery.

Preferably, the luminophor is an unitary light-emitting structure.

Preferably, an insulating insert be provided between the two batteries, and a slot communicated with the mounting groove is provided on a sidewall of the upper casing, with the insulating insert inserted between the two batteries from the slot.

Compared with the prior art, the beneficial effects of the present invention are as below:

1. The structure of the entire luminous necklace is very ingenious, and the battery case is suitable for the luminous necklace structure, which can be perfectly matched with the chain rope to supply power for the entire pendant.

2. The battery case is easy to be disassembled, and the upper and lower casings can be reinforced by the connecting end cover after being assembled, which improves the overall structural strength and is convenient to be disassembled.

3. The elastic piece 512 and the upper casing 51 are integrated, which do not need to be assembled or added with other components having a reset function; the present invention has a simple structure, occupies a small space, and is convenient for production and processing.

4. The present invention adopts the mutual aligned of the upper casing 51 and the lower casing 52 to achieve a preliminary positioning connection, and further completes a fixed connection by way of connecting the end cover 53, so that the assembly and connection of the components in the battery box are more convenient; the circuit board 61 is provided with a contact piece, and the upper casing 51 is provided with an elastic piece 512 capable of pressing the contact piece to make the circuit communicate, which is more convenient for operation.

5. During a mounting process, the position-limited rod 522 passes through the position-limited hole 611, so that the circuit board 61 can be connected to the lower casing 52; with such a structure, the circuit board 61 and the lower casing 52 can be easily disassembled to facilitate the later repair and replacement of the circuit board 61, and the position-limited rod 522 cooperates with the position-limited hole 611, which improves the stability of the circuit board 61 in the horizontal direction and also enables the circuit board 61 to be positioned faster during a mounting process.

6. An insulating insert be provided between the two batteries 62, and a slot communicated with the mounting groove is provided on a sidewall of the upper casing, with the insulating insert inserted between the two batteries 62 from the slot; in a non-use state, a long contact of two batteries 62 are likely to cause a slow discharge of the batteries 62, so that the service life of the batteries 62 is greatly shortened; with the insulating insert which can separate two batteries 62, the two batteries 62 can avoid being in contact for a long time in the non-use state, and in use, the insulation of the two batteries 62 can be realized by way of extracting the insulating inserts, so that the on and off of the two batteries 62 can be conveniently realized.

Embodiment 1

In the figures, 10-battery case; 20-chain rope; 30-light shade.

Embodiment 2

In the figures, 20-chain rope; 21-nylon rope; 30-light shade; 40-luminophor.

Embodiment 3

In the figures, 20-chain rope; 21-nylon rope; 30-light holder; 31-insertion hole; 32-clip groove; 33-receiving hole; 40-light shade; 41-insertion rod.

Embodiment 4

In the figures, 20-chain rope; 21-nylon rope; 30-light holder; 31-conical portion; 40-light shade; 41-connecting hole; 42-connecting column

Embodiment 5

In the figures, 20-chain rope; 21-nylon rope; 30-light holder; 31-insertion hole; 32-clip groove; 33-receiving hole; 40-light shade; 41-connecting hole; 42-receiving groove.

Embodiment 6

In the figures, 20-chain rope; 21-nylon rope; 30-light holder; 31-connecting block; 32-position-limited rod;

40-light shade; 41-connecting hole; 42-position-limited groove; 43-position-limited column; 44-receiving groove.

Embodiment 7

In the figures, 20-chain rope; 21-nylon rope; 30-light holder; 31-insertion hole; 32-upper snap joint; 33-receiving groove; 40-light shade; 41-connecting portion; 42-lower snap joint; 43-connecting hole; 44-partitioning groove; 45-joint portion; 46-position-limited portion.

In the figures, 50-outer casing; 51-upper casing; 511-first latching strip; 512-elastic piece; 513-protrusive rod; 52-lower casing; 521-second latching strip; 522-position-limited rod; 523-mounting groove; 524-fixing rod; 53-connecting end cover; 531-latching groove; 532-through-hole; 60-power supply component; 61-circuit board; 611-position-limited hole; 62-battery; 70-conductive wire; 71-ferrule.

DETAILED DESCRIPTION OF THE INVENTION

The technical solution of the present invention is further detailed in combination with the embodiments and the drawings as below, but these embodiments are not intended to limit the present invention.

Figure 1:
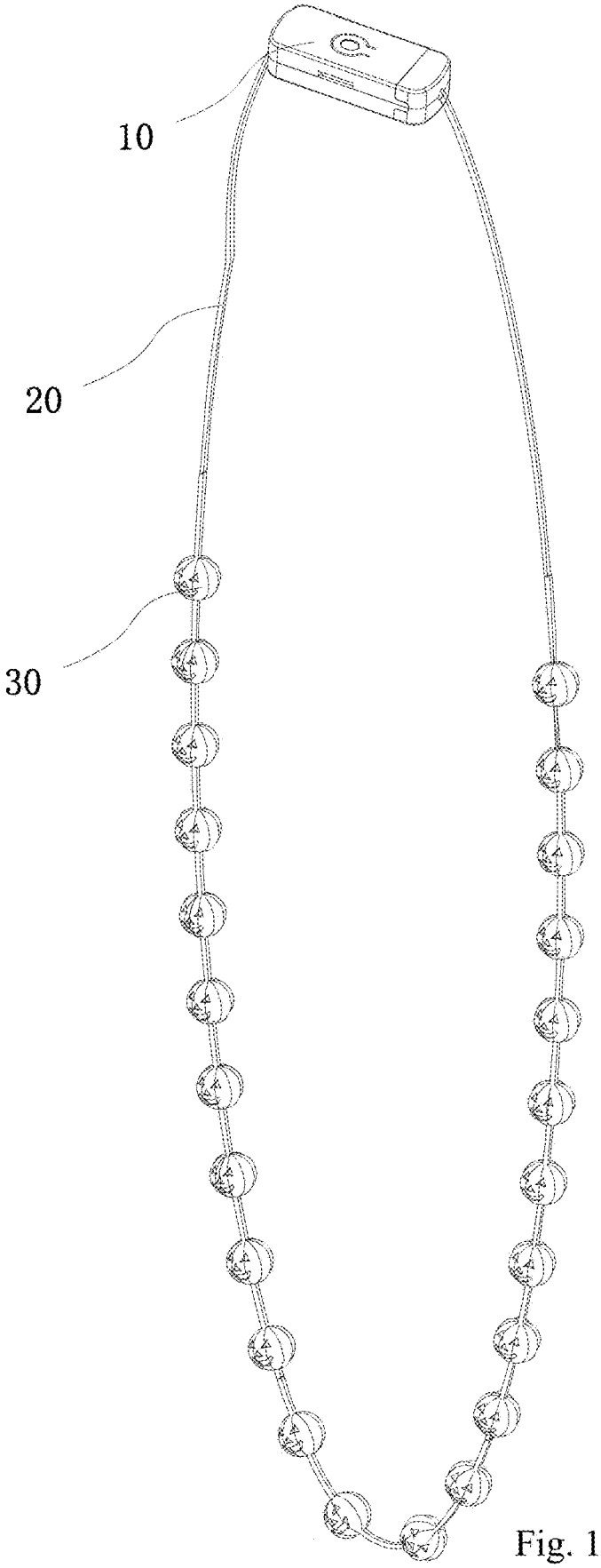
FIG. 1 is a structural diagram of the overall assembly in Embodiment 1 of the present invention.

As shown in FIG. 1, the present invention of a luminous necklace structure comprises a battery case 10, a chain rope 20 and a pendant, wherein a power supply assembly is provided in the battery case 10, both ends of the chain rope 20 are connected with the battery case 10 and electrically connected with the power supply assembly, and at least one of the pendants is connected with the chain rope 20, so that the battery case 10 can supply power to the chain rope 20 and make the pendant(s) luminous.

Embodiment 1

As shown in FIG. 1, the pendant is a light shade 30 made of a plastic material and the light shade 30 is electrically connected with a luminophor capable of being mounted on the chain rope 20, and the light shade 30 is fixed to the chain rope 20 and the luminophor via an injection molding process, which enhances the assembling efficiency as well as the connecting strength between the chain rope 20 and the light shade 30; additionally, the light shade 30 wraps the entire luminophor inside, which also enhances the strength of the connection between the luminophor and the chain 20 and protects the luminophor as well, thus prolonging the service life of the entire necklace structure.

It shall be noted that the light shade 30 can also be directly molded onto the portion of the chain rope 20 where the luminophor is not mounted, so as to form a non-luminous light shade 30 on the chain rope 20; in this way, the luminous light shade 30 is interlaced with the non-luminous light shade 30, thus making the diversified luminous effects of the necklace.

Preferably, the chain rope 20 comprises two conductive wires which are fixedly connected in parallel; the light shade 30 is directly molded on the chain rope 20 through an injection molding process, but the chain rope 20 of a spiral structure tends to rotate when heated in the injection molding process, which results in a poor fixing effect of the chain rope 20, so a large number of bubbles will be generated between the light shade 30 and the chain rope 20 after injection molding, thus resulting in a poor fixing effect between the light shade 30 and the chain rope 20.

Preferably, luminophor is an unitary light-emitting structure. Simply put, the luminophor is able to emit 360 degrees without any obscuration, thus making the entire pendant glow.

Embodiment 2

Figure 2:
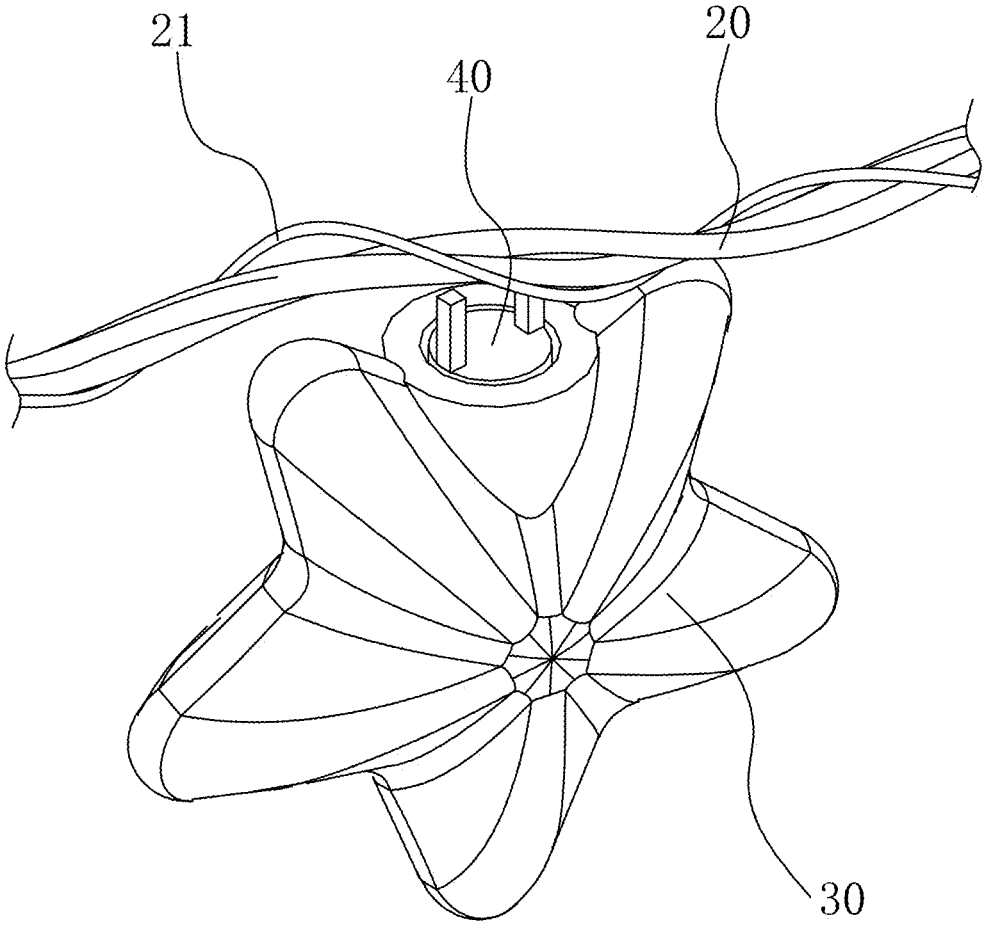
FIG. 2 is a structural diagram of the partial assembly in Embodiment 2 of the present invention.

As shown in FIG. 2, the pendant is a light shade made of a plastic material and the light shade is provided with a connecting hole, and a luminophor 40 electrically connected with the chain rope 20 can be fixed into the connecting hole; the luminophor 40 needs to be directly connected with the chain rope 20 to make itself luminous, and the luminophor 40 is directly fixed into the connecting hole of the light shade, that is to say, the connection between the light shade and the chain rope 20 is realized through the luminophor 40; the connection between the luminophor 40 and the light shade makes the close matching of the luminophor 40 and the connecting hole, or after the luminophor 40 extends into the connecting hole, the glues for bonding can be injected into the connecting hole so as to fix the luminophor 40 into the connecting hole; this kind of connecting structure is simple and easy for assembly and saves production costs.

Preferably, the chain rope 20 comprises two conductive wires which are wound with each other to form a spiral structure; this structure allows the light shade and the chain rope 20 to be connected through the later assembly without consideration of the sealing problem but just the enhanced connecting strength of the chain rope 20, so a chain rope 20 of a spiral structure is adopted in this structure to enhance the overall strength of the chain rope 20.

In this embodiment, the chain rope 20 is wound with a nylon rope 21; although no light holder is provided in this structure, the nylon rope 21 is directly wound on the chain rope 20 to enhance the tensile strength of the entire chain rope 20, thus prolonging the service life of the chain rope 20.

Embodiment 3

Figure 3:
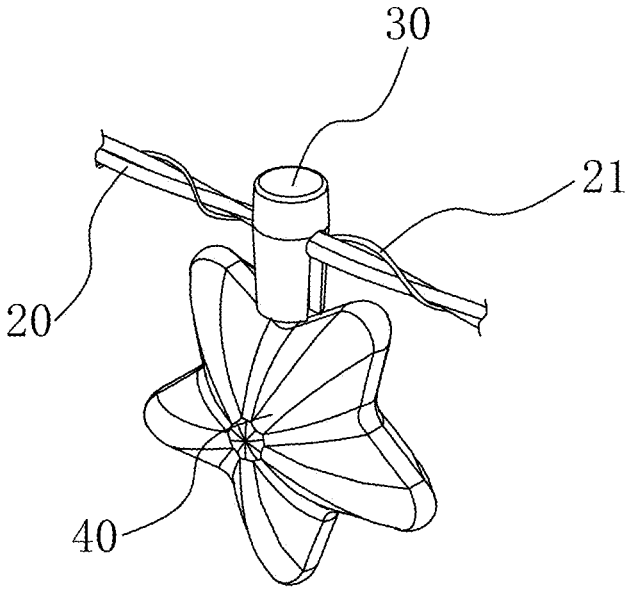
FIG. 3 is a structural diagram of the partial assembly in Embodiment 3 of the present invention.
Figure 4:
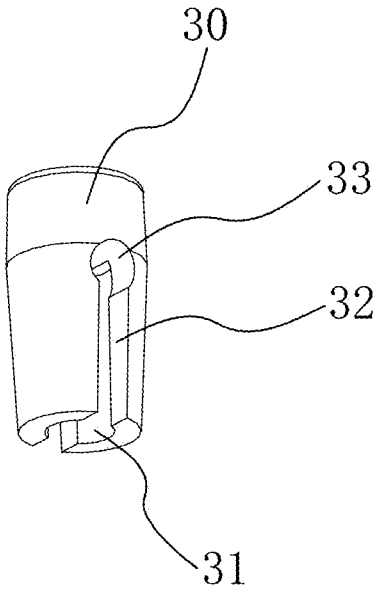
FIG. 4 is a perspective view of the light holder in Embodiment 3 of the present invention.
Figure 5:
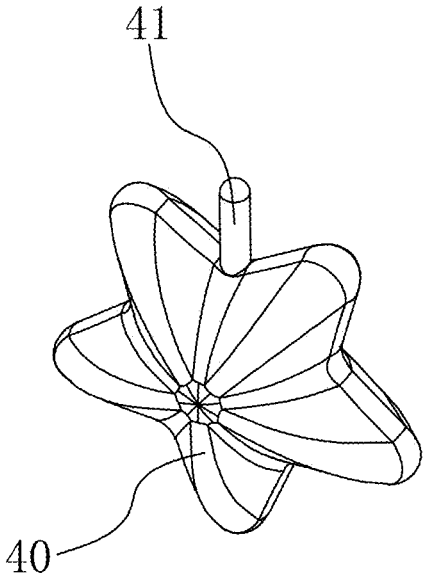
FIG. 5 is a perspective view of the light shade in Embodiment 3 of the present invention.

As shown in FIG. 3-FIG. 5, the pendant comprises a light holder 30 and a light shade 40; wherein being basically of a column structure and made of a plastic material, the light holder 30 is connected with the chain rope 20, and being of a pervious structure of all kinds of shapes, structures and colors, the light shade 40 is also of a plastic structure; the light holder 30 is provided with an insertion hole 31 on one end and the light shade 40 is provided with an insertion rod 41, wherein the insertion rod 41 is inserted into and closely matched with the insertion hole 31, which realizes the removable connection between the light holder 30 and the light shade 40 through the matching of the insertion rod 41 and the insertion hole 31, thus making the assembly of the light holder 30 and the light shade 40 more convenient.

As shown in FIG. 4, the light holder 30 is provided on one end with a clip groove 32 which traverses the light holder 30, and extends from one end of the light holder 30 toward the other end and terminates in the center of the light holder 30, wherein the clip groove 32 is communicated with the insertion hole 31 and the chain rope 20 is located in the clip groove 32; this structure enables the movable connection between the light holder 30 and the chain rope 20 and facilitates the disassembly and assembly of the light holder 30 and the chain rope 20, thus realizing the provision of a light shade 40 of different structures, shapes and colors on the same chain rope 20 and making the mix and match more convenient; when mounted, the chain rope 20 directly passes through the clip groove 32, and then the insertion rod 41 is inserted into the insertion hole 31 for assembly; the chain rope 20 directly passing through the clip groove 32 immediately realizes the fixture of the light holder 30, the light shade 40 and the chain rope 20 when the light holder 30 and the light shade 40 are fixed, without additional fixture of the light holder 30 onto the chain rope 20, which makes the assembly simple.

As shown in FIG. 4, a receiving hole 33 which traverses the light holder 30 is provided in the center of the light holder 30 and respectively communicated with the insertion hole 31 and the clip groove 32, wherein the aperture of the receiving hole 33 is larger than the width of the clip groove 32, and the chain rope 20 passes through the receiving hole 33 and is fixed with the light holder 30; with this structure, the clip groove 32 is only passed through by the chain rope 20, and the receiving hole 33 is used for receiving the chain rope 20, thus preventing the chain rope 20 being clipped by the clip groove 32 too tightly and being damaged by the corner angles of the clip groove 32 and the insertion hole 31 in use.

In general, the chain rope 20 in this embodiment also adopts the structure the same as that in Embodiment 2.

As shown in FIG. 3, a nylon rope 21 is wound on the chain rope 20, and both the nylon rope 21 and the chain 20 rope are located in the receiving groove 33; this structure is only applicable to the insertion connection structure where a receiving hole 33 is provided on the light holder 30, that is to say, different methods of connection between the light holder 30 and the nylon rope 21 can be chosen according to different insertion connection structures, thus making the structure more flexible and changeable; it is certain that when the nylon rope 21 is wound on the chain rope 20, the light holder 30 can also be integrated with the nylon rope 21 and the chain rope 20 through an injection molding process.

In this embodiment, the matching of the insertion rod 41 convexly provided on the light shade 40 and the insertion groove on the light holder 30 realizes the connection between the light holder 30 and the light shade; under normal conditions, this insertion connection structure is applicable to the condition that no luminophor is provided in the light shade 40, that is to say, the light shade 40 of this connecting structure is just a non-luminous one 40 for decoration.

Embodiment 4

Figure 6:
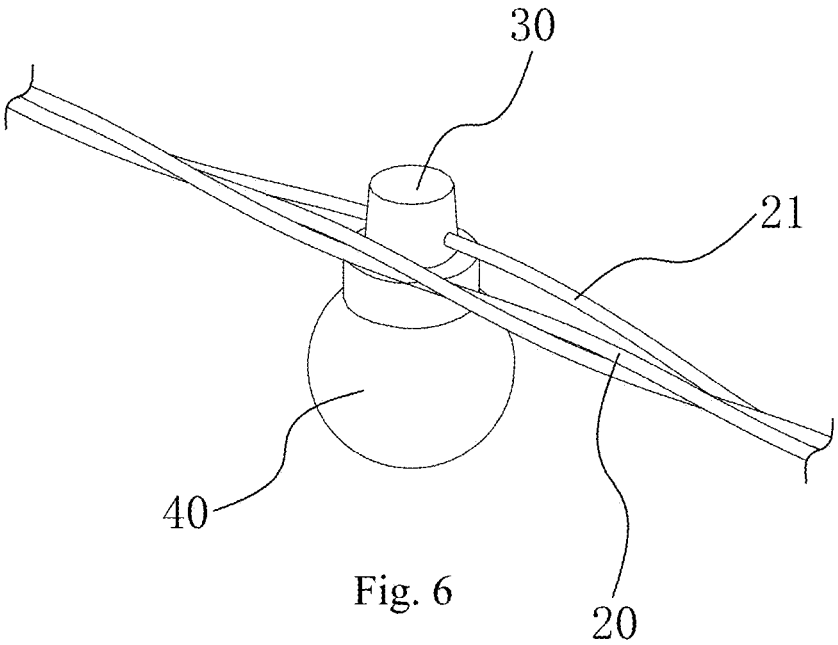
FIG. 6 is a structural diagram of the partial assembly in Embodiment 4 of the present invention.
Figure 7:
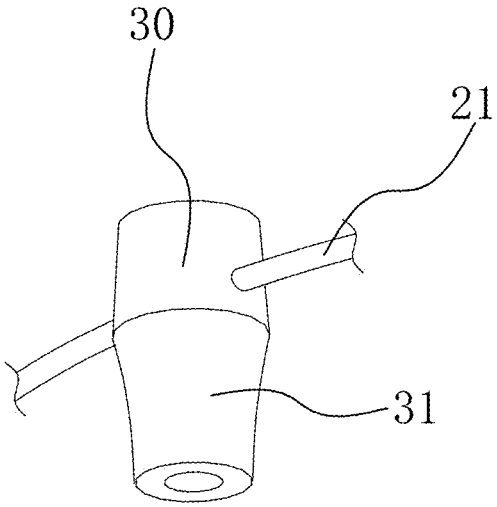
FIG. 7 is a perspective view of the light holder in Embodiment 4 of the present invention.
Figure 8:
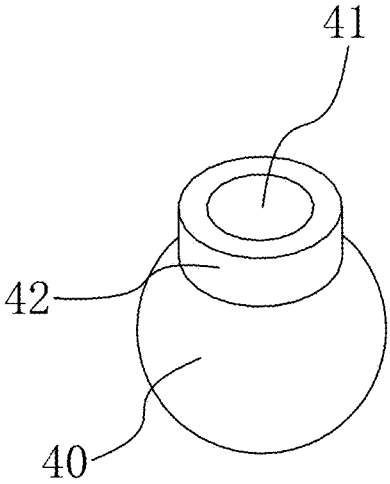
FIG. 8 is a perspective view of the light shade in Embodiment 4 of the present invention.

As shown in FIG. 6-8, the pendant comprises a light holder 30 and a light shade 40, wherein the outer diameter of the light holder 30 gradually reduces from its center toward the end to form a conical portion 31 (actually, the conical portion 31 is applicable to the light holder 30 of all insertion connection structures), and the light shade 40 is provided with a connecting hole 41 into which one end of the light holder 30 is inserted and closely matched with it; similarly, the direct insertion of the light holder 30 into the connecting hole 41 realizes the removable connection between the light holder 30 and the light shade 40, thus making the assembly of the light holder 30 and the light shade 40 more convenient.

In this insertion connection structure, the chain rope 20 cannot be fixed onto the light holder 30, so this insertion connection structure (if without any improvement) cannot realize the provision of a luminophor electrically connected with the chain rope 20 in the light shade 40; therefore, this structure is only applicable to the connection between the light holder 30 and the light shade 40 without any luminophors.

As shown in FIG. 8, the light shade 40 is convexly provided with a connecting column 42 on which a connecting hole 41 is provided, and the light holder 30 is inserted into and closely matched with the connecting column 42.

For some light shade 40 of a special structure, such as pentagram, it cannot be connected with the light holder 30; To facilitate the connection, a connecting column 42 can be provided between two corners of the light shade 40 of a pentagram structure, and then a hole is provided on the connecting column 42, thus facilitating the connection between the light holder 30 and the light shade 40; it is certain that this structure also aims to facilitate the disassembly and assembly of the light shade 40 and the light holder 30.

In general, the chain rope 20 in this embodiment also adopts the structure the same as that in Embodiment 2.

As shown in FIG. 6, a nylon rope 21 is wound on the chain rope 20 and traverses the light holder 30 which is fixedly connected with the nylon rope 21 through an injection molding process.

The provision of the nylon rope 21 enhances the strength of the chain rope 20, which makes the chain rope 20 capable of withstanding more weight of the light holder 30 and the light shade 40 to prevent the chain rope 20 from being easily broken, and the injection molding process can realize one-off molding, which enhances the assembling efficiency as well as the connecting strength between the chain rope 20 and the light shade 30.

Under normal conditions, this insertion connection structure is only applicable to the condition that no luminophor is provided in the light shade 40.

Embodiment 5

Figure 9:
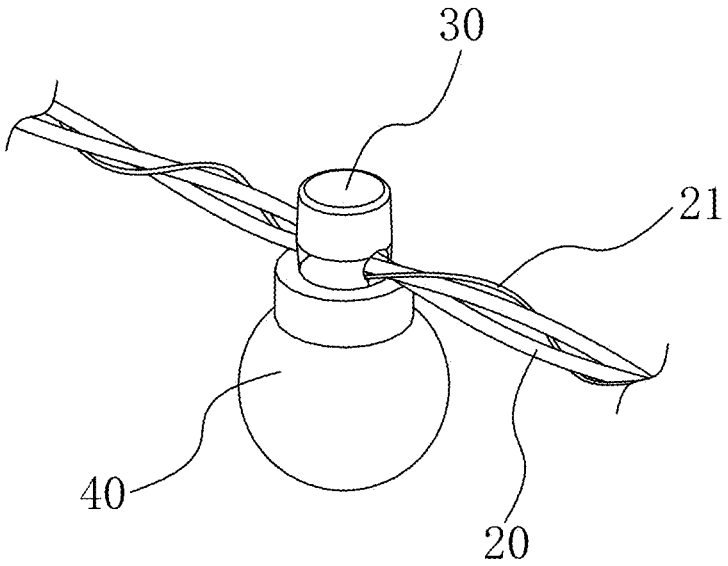
FIG. 9 is a structural diagram of the partial assembly in Embodiment 5 of the present invention.
Figure 10:
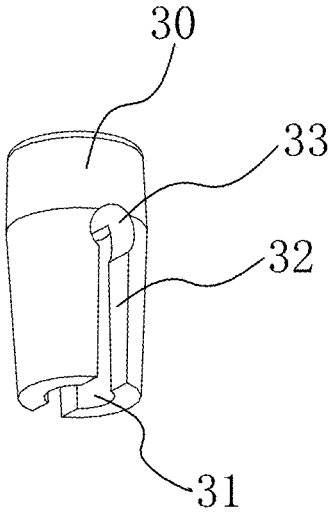
FIG. 10 is a perspective view of the light holder in Embodiment 5 of the present invention.
Figure 11:
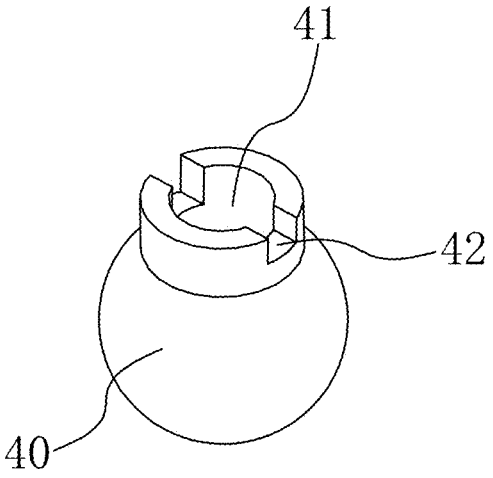
FIG. 11 is a perspective view of the light shade in Embodiment 5 of the present invention.
Figure 12:
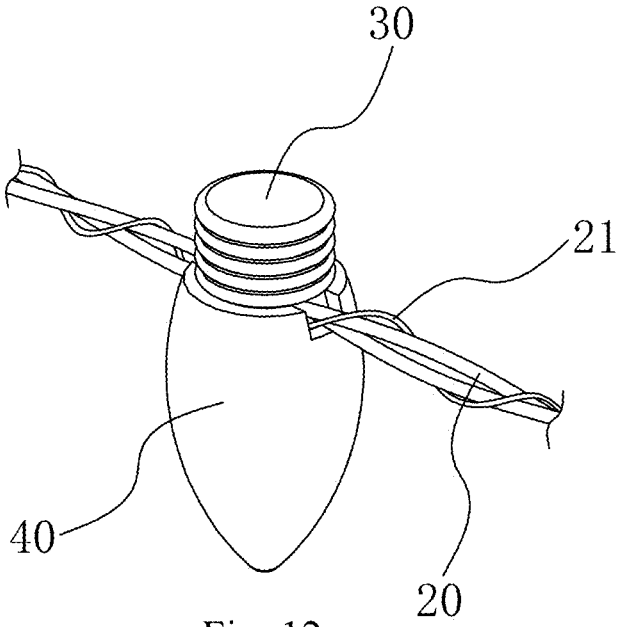
FIG. 12 is a structural diagram of the partial assembly in Embodiment 6 of the present invention.

As shown in FIG. 9-11, the structure of the light holder 30 which is also provided with an insertion hole 31, a clip groove 32 and a receiving hole 33, remains the same as that in Embodiment 3, and the structure of the light shade 40 is similar to that in Embodiment 4, that is to say, the light holder 30 and the light shade 40 are of a general structure, and both are allowed for a liberal mix and match in use, thus facilitating the processing of the light holder 30 and the light shade 40.

Additionally, the light shade 40 is also provided with a connecting hole 41 in which a luminophor (not shown in the figure) fixedly connected with it can be provided, and the luminophor is electrically connected with the chain 20; the light shade 40 is provided with a connecting hole 41 into which the luminophor can be embedded, which makes the luminophor luminous and emit light from the light shade 40 through the connection between the luminophor and the chain rope 20, thus bringing a luminous effect to the light shade 40; the connecting hole 41 plays a role of housing the luminophor as well as the connection, and this structure is also applicable to the condition that no luminophor is provided.

As shown in FIG. 10, the light holder 30 is provided on the top with a receiving groove 42 which traverses its side wall, and the receiving groove 42 is communicated with the connecting hole 41; the receiving groove 42, with its function remaining the same as the above-mentioned receiving hole 32, is also used for receiving the chain rope 20 to prevent the chain rope 20 from being damaged when clipped between the light holder 30 and the light shade 40 in the process of the insertion connection assembly, that is to say, without the above-mentioned receiving hole 32, the structure of the receiving groove 42 can be provided on the light shade 40, which can also play a role of protecting the chain role 20; it is certain that both structures can also be used simultaneously.

In this embodiment, the chain rope 20 adopts a spiral structure and can also be wound with a nylon rope 21, so that the nylon rope 21 and the chain rope 20 are both located in the receiving hole 32 simultaneously.

In both this embodiment and Embodiment 4, the light holder 30 is inserted into the light shade 40; therefore, this embodiment can be deemed as a further improvement to Embodiment 4, despite the different methods of connection between the light holder 30 and the chain rope 20.

Under normal conditions, this insertion connection structure is applicable to the condition that a luminophor is provided in the light shade 40; it is certain that the light shade 40 and the light holder 30 can be connected without the provision of a luminophor separately.

Embodiment 6

As shown in FIG. 12-15, the pendant comprises a light holder 30 which is symmetrically provided with connecting blocks 31 at its bottom and a light shade 40 on which a connecting hole 41 is provided, wherein the chain rope 20 is provided between the two connecting blocks 31 which extend into and are closely matched with the connecting hole 41; the adoption of this structure also realizes the connection between the light holder 30 and the light shade 40; this structure is similar to that in Embodiment 5 where the chain rope 20 can directly pass through between the two connecting blocks 31, thus making the assembly rather convenient and simple.

Figure 13:
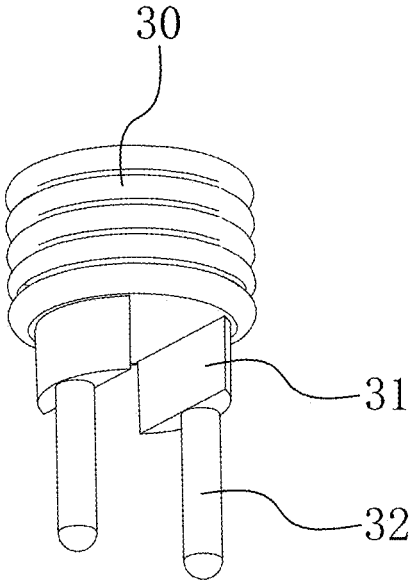
FIG. 13 is a perspective view of the light holder in Embodiment 6 of the present invention.
Figure 14:
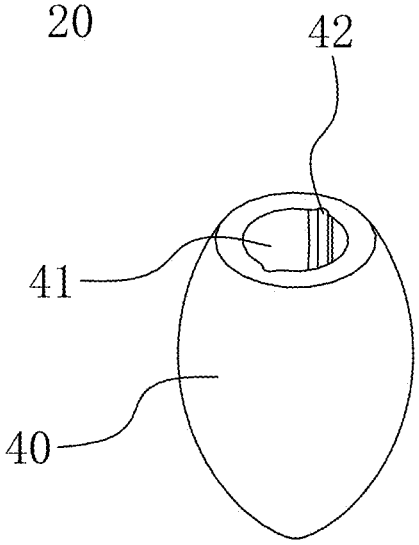
FIG. 14 is a perspective view of the light shade in Embodiment 6 of the present invention.

As shown in FIG. 13 and FIG. 14, a position-limited rod 32 is convexly provided at the bottom of the connecting block 31 and a position-limited groove 42 is provided on the inside wall of the connecting hole 41, wherein the position-limited rod 32 is inserted into the position-limited groove 42; the matching of the position-limited rod 32 and the position-limited groove 42 enhances the tightness of the connection between the light holder 30 and the light shade 40; meanwhile, the position-limited rod 32 plays a role of restricting the position, which prevents the light holder 30 from rotating relative to the light shade 40, thus improving the stability of the light holder 30.

Figure 15:
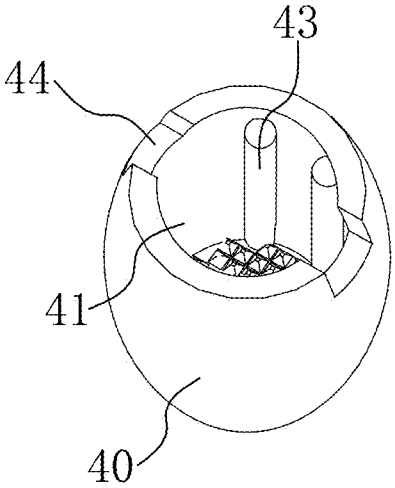
FIG. 15 is a perspective view of another structure of the light shade in Embodiment 6 of the present invention.

For this position-limited structure, it is also possible to adopt another structure, as shown in FIG. 15, that is, the connecting hole 41 is provided inside with at least one set of position-limited columns 43 fixedly connected with its inside wall, wherein each set has two position-limited columns and the position-limited rod 32 is located between two position-limited columns 43 in each set; the position-limited rod 32 is located between the two position-limited columns 43, which plays a role the same as the matching of the position-limited 32 and the position-limited groove 42.

In this embodiment, the connecting method of the light holder 30 and the light shade 40 is similar to that in Embodiment 5; therefore, the light shade 40 can also be provided with a receiving groove 44 in which the chain rope 20 is located, which can also play a role of protecting the chain rope 20; the chain rope 20 adopts a spiral structure and can also be wound with a nylon rope 21, so that the nylon rope 21 and the chain rope 20 are both located in the receiving groove 44 simultaneously.

Under normal conditions, this insertion connection structure is applicable to the condition that a luminophor is provided in the light shade 40; it is certain that the light shade 40 and the light holder 30 can be connected without the provision of a luminophor separately.

Embodiment 7

Figure 16:
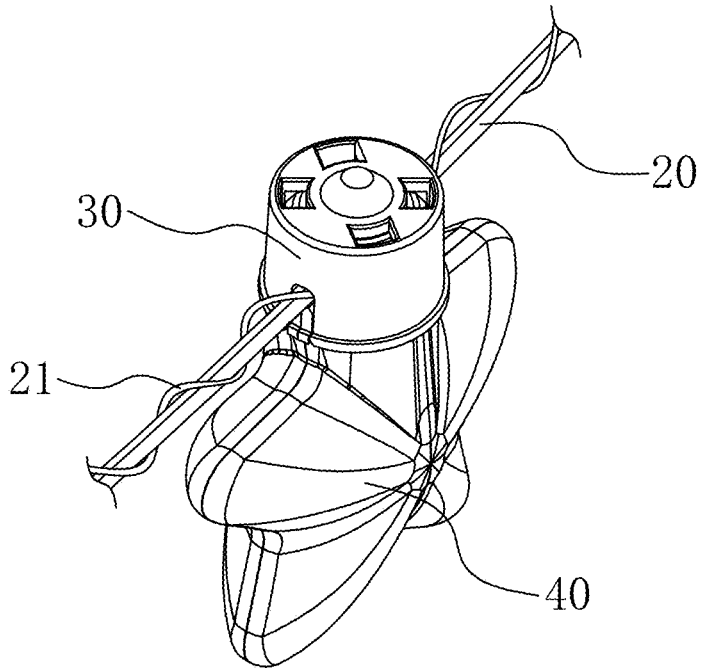
FIG. 16 is a structural diagram of the partial assembly in Embodiment 7 of the present invention.
Figure 17:
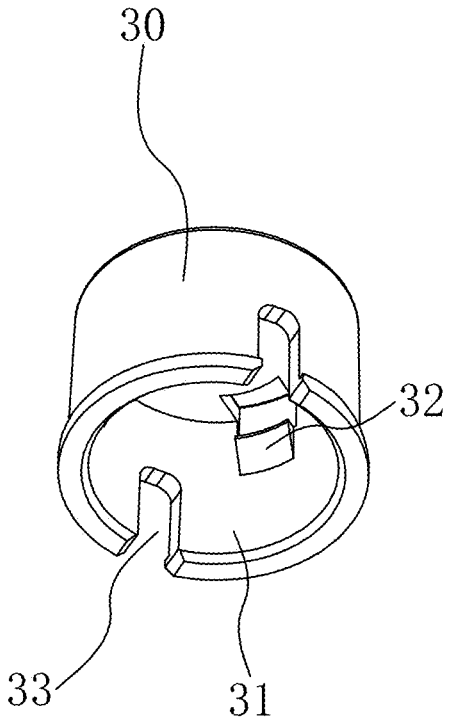
FIG. 17 is a perspective view of the light holder in Embodiment 7 of the present invention.
Figure 18:
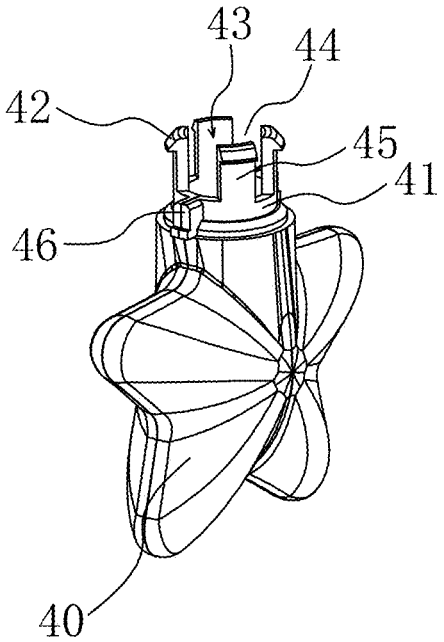
FIG. 18 is a perspective view of the light shade in Embodiment 7 of the present invention.

As shown in FIG. 16-18, the pendant comprises a light holder 30 connected with the chain rope 20 and a light shade 40 on which a connecting portion 41 is provided, wherein an upper snap joint 32 is provided on the inside wall of the insertion hole 31 which is provided at the bottom of the light holder 30, a lower snap joint 42 is provided on the outside surface of the connecting portion 41, so that the connecting portion 41 is inserted into the insertion hole 31 and the upper snap joint 32 is jointed onto the lower snap joint 42.

In this embodiment, the light holder 30 and the light shade 40 are connected through a method different from those mentioned in the several embodiments above: when the connecting portion 41 is inserted into the insertion hole 31, the upper snap joint 32 is jointed with the lower snap joint 42, thus making the light holder 30 and the light shade 40 fixed; this connecting method brings a better effect of the fixture of the light holder 30 and the light shade 40.

As shown in FIG. 18, a connecting hole 43 is provided on the connecting portion 41 on which at least two partitioning grooves 44 which traverse the connecting portion 41 are provided, wherein the chain rope 20 is located in the partitioning grooves 44 which are communicated with the connecting hole 43 and form a movable joint portion 45 between the two partitioning grooves 44, and the lower snap joint 42 is provided on the joint portion 45.

The provision of the connecting hole 43 and the partitioning grooves 44 makes the whole connecting portion 41 partitioned into a plurality of joint portions 45; in this way, each of the joint portions 45 is swingable relative to the connecting portion 41, so that when the light holder 30 is mounted, the lower snap joint 42 can be more easily jointed by the upper snap joint 32, thus making the assembly more convenient, and it is just suitable for a luminophor to be provided in the connecting hole 43.

As shown in FIG. 16, the receiving grooves 33 are symmetrically provided on the side wall of the light holder 30 and communicated with the partitioning grooves 44, with the chain rope 20 located in both the receiving grooves 33 and the partitioning grooves 44; both the receiving groove 33 and the partitioning grooves 44 play a role of protecting the chain rope 20 so as to prevent it from being damaged when clipped between the light holder 30 and the light shade 40.

As shown in FIG. 18, a position-limited portion 46 is provided on the outside surface of the connecting portion 41 and located in the receiving groove 33; with the chain rope 20 located in the receiving groove 33, the position-limited portion 46, when located in the receiving groove 33, can keep the chain rope 20 pushing against and fixed in the receiving groove 33, thus enhancing the effect of the fixture of the chain rope 20 with the light holder 30 and the light shade 40.

In this embodiment, the chain rope 20 adopts a double-line structure and can also be wound with a nylon rope 21, so that the nylon rope 11 and the chain rope 20 are both located in the receiving hole 33 simultaneously; it is certain that the chain rope 20 can also adopt a spiral structure.

With the light shade 40 provided with a connecting hole 43, this snap-joint connection structure is also applicable to the condition that a luminophor is provided in the light shade 40; it is certain that the light shade 40 and the light holder 30 can be connected without the provision of a luminophor separately.

The above-mentioned connecting structures in the present invention can be divided into an injection-molding connection, an insertion connection and a joint connection; in addition to the injection-molding connecting structure and the joint connecting structure, other structures are all of the insertion connecting structure, and all of the above-mentioned connecting structures allow the mixed use in the same necklace structure.

The adoption of the above-mentioned structures in the present invention realizes a variety of connecting methods of the chain rope 20 and the pendant, the injection molding method enhances the strength of the connection between the pendant and the chain rope 20, and the insertion connection and joint connection facilitate the disassembly and assembly of the light holder 30 and the light shade 40 as well as the change of the luminophor located in the light shade 40 which is convenient to use, thus prolonging the service life of the luminous necklace and meanwhile saving the costs. Additionally, a variety of methods of the insertion connection between the light holder 30 and the light shade 40 are designed, which realizes the diversified connections between the light holder 30 and the light shade 40; a variety of different insertion-connection methods realizes both provision and non-provision of a light in the light shade 40, thus enhancing the luminous effect of the necklace.

As shown in FIG. 1, FIG. 19, FIG. 20, and FIG. 21, on the basis of the above embodiment, the battery case comprises an outer casing 50 and a power supply assembly 60 provided in the outer casing 50, with two ends of the two conductive wires connected to the outer casing 50 and the electrically conductive wires electrically connected to the power supply assembly 60.

The outer casing 50 is of a square shape or may be of other shapes such as a circular shape or an elliptical shape; two ends of the outer casing 50 are respectively provided with a through-hole 532 for connecting the wire to the power supply assembly 60 in the outer casing 50. The structure of the entire luminous necklace is very ingenious, and the battery case is suitable for the luminous necklace structure, which can be perfectly matched with the chain rope to supply power for the entire pendant.

As shown in FIG. 1, FIG. 19, FIG. 20, and FIG. 21, on the basis of the above embodiment, the outer casing 50 comprises an upper casing 51, a lower casing 52 and a connecting end cover 53, wherein the upper casing 51 is detachably connected to the lower casing 52, and an inner cavity is formed between the upper casing and the lower casing for accommodating the power supply assembly 60, with the connecting end cover 53 sleeved at the ends of the upper case 51 and the lower case 52.

The outer casing 50 comprises a detachable upper casing 51 and a lower casing 52, with the upper casing 51 and the lower casing 52 mutually opposed to each other to form a receiving cavity, and the upper casing 51 is provided with an elastic piece capable of moving relative to the upper casing 51 and sleeved on the ends of the upper casing 51 and the lower casing 52 by the connecting end cover 53, so that the connection is more compact and reliable.

Figure 19:
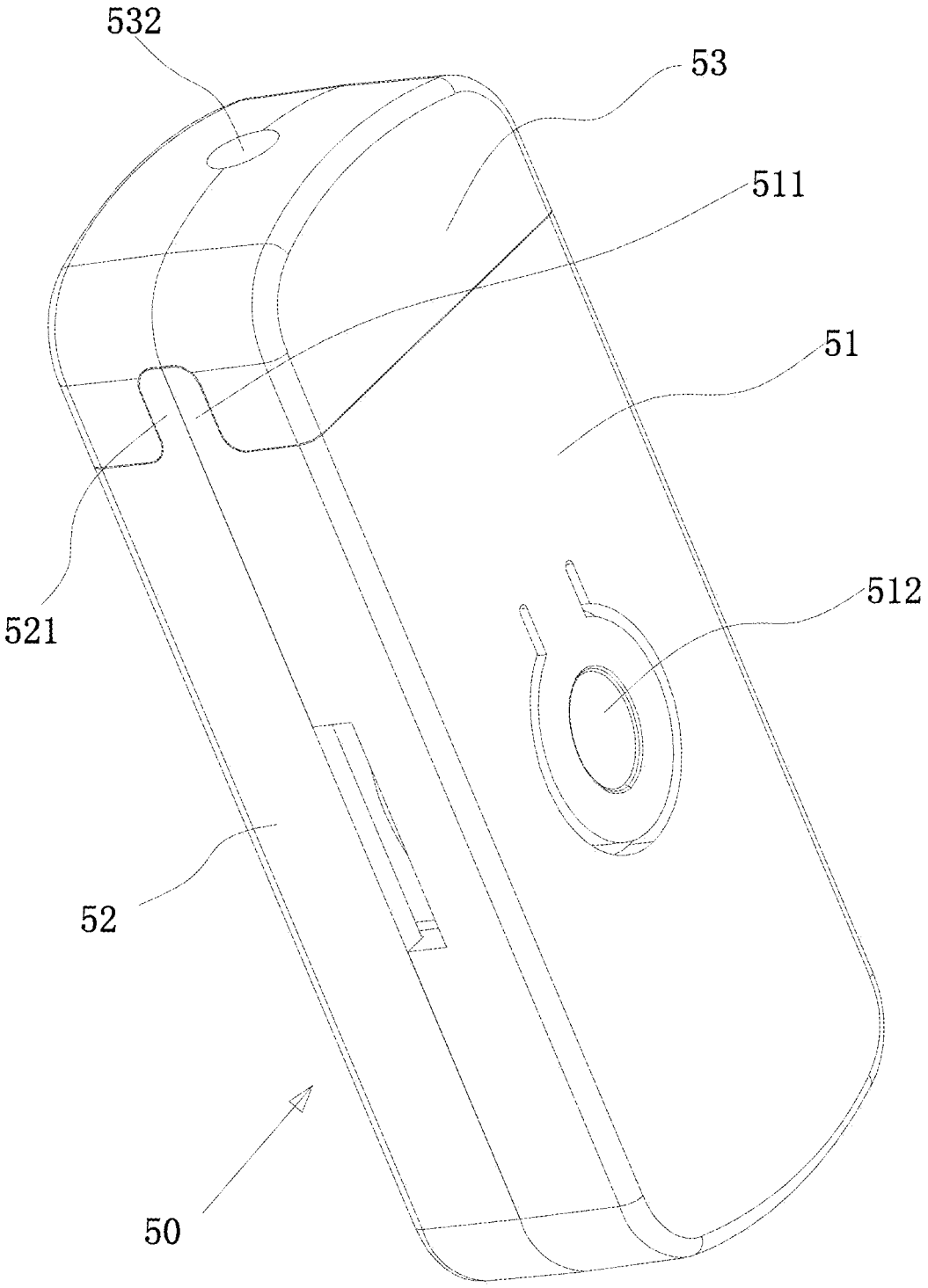
FIG. 19 is a structural diagram of the battery case of the present invention.
Figure 20:
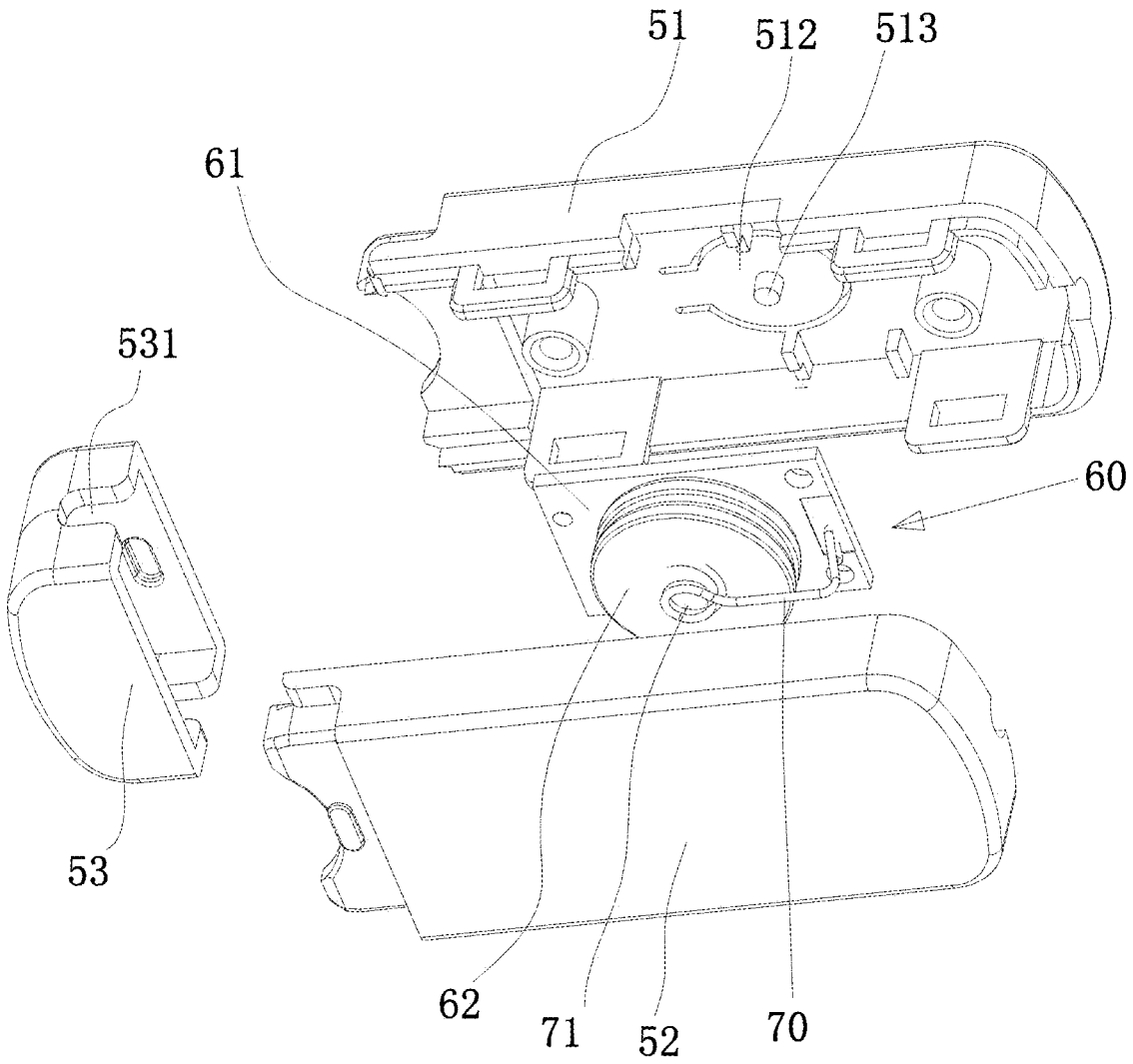
FIG. 20 is an explosive diagram of the battery case of the present invention.
Figure 21:
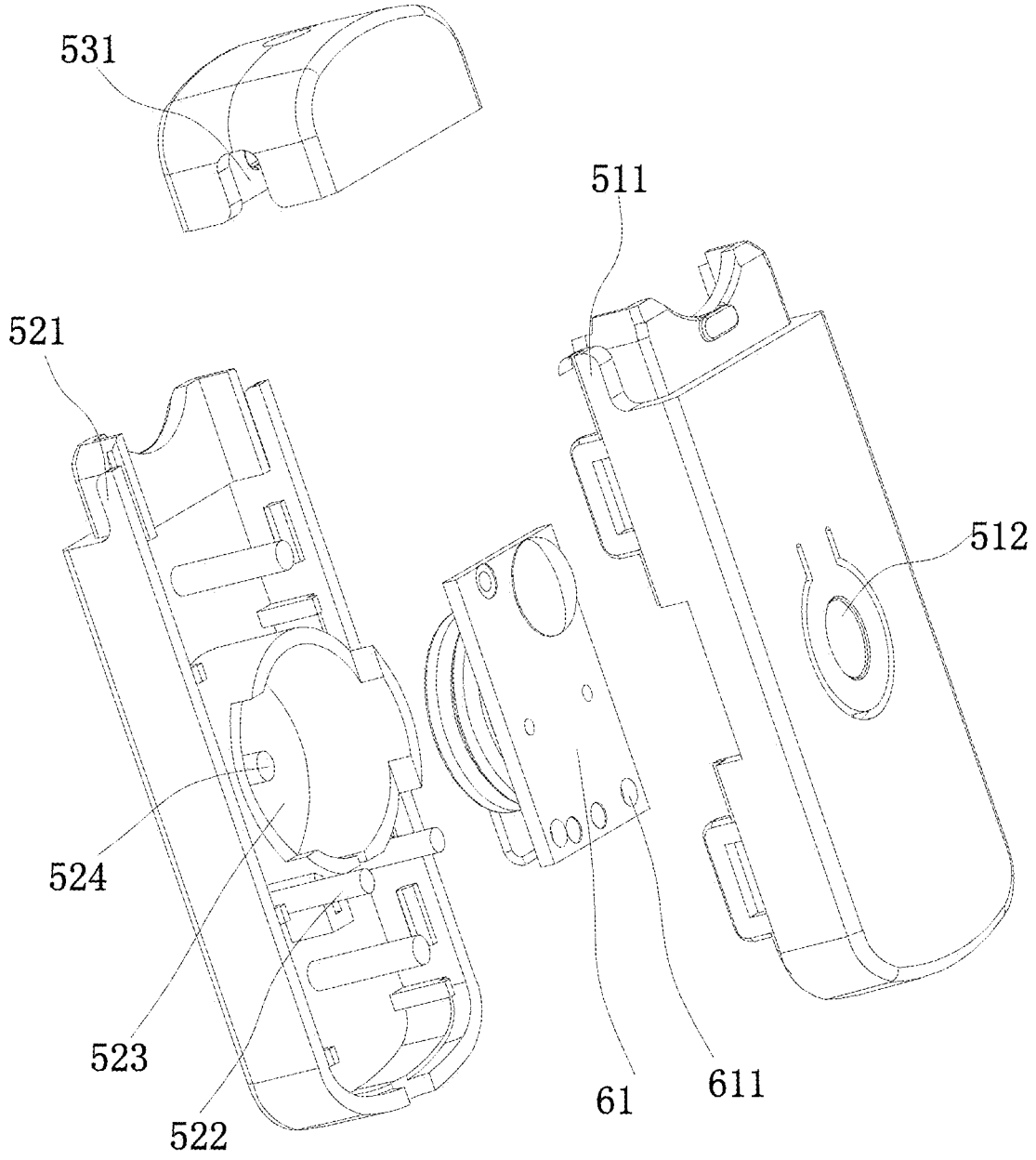
FIG. 21 is a structural diagram of the lower casing of the present invention.

As shown in FIG. 19, FIG. 20, and FIG. 21, on the basis of the above embodiment, the ends of the upper casing 51 and the lower casing 52 are respectively provided with a first latching strip 511 and a second latching strip 521, with the first latching strip 511 in contact with the second latching strip 521; the connecting end cover 53 is provided with a latching slot 531, with the first latching strip 511 and the second latching strip 521 provided in the latching slot 531.

Preferably, the upper casing 51 and the lower casing 52 have strip-shaped latching strips on the ends thereof, and the two latching strips are merged together and inserted into the latching slots 531 so that the upper casing 51 and the lower casing 52 are latched together.

As shown in FIG. 19, FIG. 20, and FIG. 21, on the basis of the above embodiment, the surface of the upper casing 51 is provided with a strip-shaped groove extending through the upper casing 51, and two ends of the strip-shaped groove are spaced apart and adjacent to each other and enclose an elastic piece 512, with the elastic piece 512 and the upper casing 51 connected.

The elastic piece 512 is actually a switch, and by way of pressing the strip-shaped groove, the battery case can be triggered to work.

Because the elastic piece 512 and the upper casing 51 are separated by a strip-shaped groove, the elastic piece 512 has a certain elasticity; after the elastic piece 512 is pressed, the elastic piece 512 can be automatically reset and is convenient to be used, compared with the existing elastic structure; the elastic piece 512 and the upper casing 51 are integrated, which do not need to be assembled or added with other components having a reset function; the present invention of a simple structure occupies a small space and is convenient for production and processing.

As shown in FIG. 19, FIG. 20 and FIG. 21, on the basis of the above embodiment, the power supply component 60 comprises a circuit board 61 and a battery 62, with the circuit board 61 provided with a contact piece electrically connected to the battery 62.

The receiving cavity is further provided with a conductive wire 70, with one end of the conductive wire 70 in contact with the negative electrode of the battery 62 while the other end is spaced apart from the battery 62 and electrically connected to the circuit board 61.

During a working process, the elastic piece 512 is pressed, so that the contact piece and the battery 62 are energized; at this time, an indirect switching circuit is formed between the battery 62, the circuit board 61 and the conductive wire 70, so that the battery 62 supplies power to the circuit board 61 and conveys the current to an electronic device connected to the circuit board 61.

The present invention adopts the mutual aligned of the upper casing 51 and the lower casing 52 to achieve a preliminary positioning connection, and further completes a fixed connection by way of connecting the end cover 53, so that the assembly and connection of the components in the battery box are more convenient; the circuit board 61 is provided with a contact piece, and the upper casing 51 is provided with an elastic piece 512 capable of pressing the contact piece to make the circuit communicate, which is more convenient for operation.

As shown in FIGS. 19, 20, and 21, on the basis of the above embodiment, the bottom of the elastic piece 512 has a downwardly extending rod 513 which can abut against the contact piece.

The protrusive rod 513 can abut against the contact piece and energize the contact piece and the battery 62; after the protrusive rod 513 is provided, the contact piece is more easily touched when the elastic piece 512 is pressed, thus reducing the force required to press the elastic piece 512 and improve the comfort when being pressed.

As shown in FIG. 19, FIG. 20, and FIG. 21, on the basis of the above embodiment, the inner surface of the lower casing 52 is provided protrusively with at least one position-limited rod 522, and one end of the circuit board 61 is correspondingly provided with at least one position-limited hole 611, with the position-limited rod 522 extending into the position-limited hole 611 and making the circuit board 61 connected to the lower casing 52.

The position-limited rod 522 has two side walls respectively adjacent to the lower casing 52, and one end of the circuit board 61 is correspondingly provided with two position-limited holes 611, with the two position-limited holes 611 respectively located at two corners of one end of the circuit board 61; during a mounting process, the position-limited rod 522 passes through the position-limited hole 611, so that the circuit board 61 can be connected to the lower casing 52; with such a structure, the circuit board 61 and the lower casing 52 can be easily disassembled to facilitate the later repair and replacement of the circuit board 61, and the position-limited rod 522 cooperates with the position-limited hole 611, which improves the stability of the circuit board 61 in the horizontal direction and also enables the circuit board 61 to be positioned faster during a mounting process.

As shown in FIG. 19, FIG. 20, and FIG. 21, on the basis of the above embodiment, the lower casing 52 is formed with a mounting groove 523 for mounting a battery 62, and the circuit board 61 is provided above the mounting groove 523 and connected to the battery 62.

The mounting groove 523 of a collar-like structure has a position-limited block; the circuit board 61 is provided on the mounting groove 523, with the edge of the circuit board 61 in contact with the position-limited block, and the battery 62 is provided in the mounting slot 523, which improves the stability of the battery 62 mounted on the lower casing 52.

As shown in FIG. 19, FIG. 20, and FIG. 21, on the basis of the above embodiment, the connecting end cover 53 is provided with a through-hole 532 communicated with the inner cavity; the conductive wire is provided in the through-hole 532 and connected to the circuit board 61.

As shown in FIG. 19, FIG. 20, and FIG. 21, on the basis of the above embodiment, there are two batteries 62 which are superimposedly arranged, wherein one of the batteries 62 is in contact with the circuit board 61 while the other 62 is connected to the bottom of the groove of the mounting groove 523.

The installation of two batteries 62 increases the power supply and service life of the battery 62 and avoids a frequent replacement of the battery 62.

Furthermore, an insulating insert may be provided between the two batteries 62, and a slot communicated with the mounting groove is provided on a sidewall of the upper casing, with the insulating insert inserted between the two batteries 62 from the slot; in a non-use state, a long contact of two batteries 62 are likely to cause a slow discharge of the batteries 62, so that the service life of the batteries 62 is greatly shortened; with the insulating insert which can separate two batteries 62, the two batteries 62 can avoid being in contact for a long time in the non-use state, and in use, the insulation of the two batteries 62 can be realized by way of extracting the insulating inserts, so that the on and off of the two batteries 62 can be conveniently realized.

As shown in FIG. 19, FIG. 20, and FIG. 21, on the basis of the above embodiment, the inner cavity is provided with a conductive wire 70, with one end of the conductive wire 70 clamped to the bottom of the battery 62 while the other end separated from the battery 62 and electrically connected to the circuit board 61.

As shown in FIG. 19, FIG. 20, and FIG. 21, on the basis of the above embodiment, one end of the conductive wire 70 is bent to form a ferrule 71, and a lower surface of the mounting groove 523 is protrusively provided with a fixing rod 524, with the ferrule 71 sleeved on the fixing rod 524 and in contact with the battery 62.

One end of the conductive wire 70 in contact with the battery 62 is spirally bent to form a ferrule 71; a fixing rod 524 is protrusively provided in the middle of the lower surface of the cover panel and abuts against the negative electrode of the battery 62, with the ferrule 71 sleeved on the fixing rod 524 and in contact with the batteries 62; one end of the conductive wire 70 in contact with the batteries 62 is sleeved on the fixing rod 524 through the ferrule 71, which functions to fix the conductive wire 70 to ensure that the conductive wire 70 and the battery 62 are normal in contact and the conductive wire 70 is prevented from being separated from the battery 62; the ferrule 71 is directly sleeved on the fixing rod 524, which further facilitates the disassembly and assembly of the conductive wire 70; at the same time, the fixing rod 524 abuts against the batteries 62, further increasing the stability of the batteries 62. The working principle of the invention is as follows:

two batteries 62 are energized firstly. The elastic piece 512 is pressed, so that the contact piece and the battery 62 are energized; at this time, an indirect switching circuit is formed between the battery 62, the circuit board 61 and the conductive wire 70, so that the battery 62 supplies power to the circuit board 61 and conveys the current to an electronic device connected to the circuit board 61, and the circuit board 61 conveys current to the conductive wires and supplies power to the lamp, thus causing the pendant to illuminate.

When the battery 62 is replaced, the connection end cover 53 is pulled out firstly, and then the upper casing 51 and the lower casing 52 are separated to complete the replacement of the battery 62.

The embodiments described herein are only intended to give examples based on the spirit of the present invention. Those skilled in the field can make various modifications or supplements or adopt alternative similarities to the described embodiments, without departing from the spirit of the present invention or exceeding the scope defined in the claims attached.

What is claimed is:

1. A luminous necklace structure, comprising a battery case;

a chain rope having two ends, both of the two ends connected with the battery case;

at least one pendant connected with the chain rope;

wherein the battery case can supply power to the chain rope and make the pendant luminous;

the chain rope comprises two conductive wires which are fixedly connected in parallel;

the battery case comprises a casing and a power supply assembly provided in the casing, with two ends of the two conductive wires connected to the casing and the conductive wires electrically connected to the power supply assembly;

the outer casing comprises an upper casing, a lower casing and a connecting end cover, wherein the upper casing is detachably connected to the lower casing, and an inner cavity is formed between the upper casing and the lower casing for accommodating the power supply assembly, with the connecting end cover sleeved at ends of the upper casing and the lower casing.

2. The luminous necklace structure as claimed in claim 1, wherein the pendant is a light shade which is electrically connected with a luminophor capable of being mounted on the chain rope, and the light shade is fixed to the chain rope and the luminophor via an injection molding process.

3. The luminous necklace structure as claimed in claim 1, wherein the ends of the upper casing and the lower casing are respectively provided with a first latching strip and a second latching strip, with the first latching strip is in contact with the second latching strip; the connecting end cover is provided with a latching slot, with the first latching strip and the second latching strip provided in the latching slot.

4. The luminous necklace structure as claimed in claim 3, wherein the surface of the upper casing is provided with a strip-shaped groove extending through the upper casing, and two ends of the strip-shaped groove are spaced apart and adjacent to each other and enclose an elastic piece, with the elastic piece and the upper casing connected.

5. The luminous necklace structure as claimed in claim 4, wherein the power supply component comprises a circuit board and a battery, with the circuit board is provided with a contact piece electrically connected to the battery.

6. The luminous necklace structure as claimed in claim 5, wherein the bottom of the elastic piece has a downwardly extending rod which can abut against the contact piece.

7. The luminous necklace structure as claimed in claim 5, wherein the inner surface of the lower casing is provided protrusively with at least one position-limited rod, and one end of the circuit board is correspondingly provided with at least one position-limited hole, with the position-limited rod extending into the position-limited hole and making the circuit board connected to the lower casing.

8. The luminous necklace structure as claimed in claim 5, wherein the lower casing is formed with a mounting groove for mounting a battery, and the circuit board is provided above the mounting groove and connected to the battery.

9. The luminous necklace structure as claimed in claim 1, wherein the connecting end cover is provided with a through hole communicated with the inner cavity.

10. The luminous necklace structure as claimed in claim 5, wherein there are two batteries which are superimposedly arranged, wherein one of the batteries is in contact with the circuit board while the other is connected to the bottom of the groove of the mounting groove.

11. The luminous necklace structure as claimed in claim 10, wherein the inner cavity is provided with a conductive wire, with one end of the conductive wire clamped to the bottom of the battery while the other end separated from the battery and electrically connected to the circuit board.

12. The luminous necklace structure as claimed in claim 11, wherein one end of the conductive wire is bent to form a ferrule, and a lower surface of the mounting groove is protrusively provided with a fixing rod, with the ferrule sleeved on the fixing rod and in contact with the battery.

13. The luminous necklace structure as claimed in claim 2, wherein the luminophor is a unitary light-emitting structure.

14. The luminous necklace structure as claimed in claim 10, wherein an insulating insert be provided between the two batteries, and a slot communicated with the mounting groove is provided on a sidewall of the upper casing, with the insulating insert inserted between the two batteries from the slot.

* * * * *